United States Patent [19]

Eich et al.

[11] Patent Number: 4,724,017

[45] Date of Patent: Feb. 9, 1988

[54] UNSUPPORTED PROPELLANT CHARGE ELEMENT AND COMPACT CHARGE PRODUCED THEREFROM

[75] Inventors: Johannes Eich, Troisdorf; Erwin Radecke, Bergisch-Gladbach, both of Fed. Rep. of Germany

[73] Assignee: Dynamit Nobel Aktiengesellschaft, Troisdorf, Fed. Rep. of Germany

[21] Appl. No.: 30,686

[22] Filed: Mar. 27, 1987

[30] Foreign Application Priority Data

Mar. 27, 1986 [DE] Fed. Rep. of Germany ..... 3610424

[51] Int. Cl.[4] ..... C06B 45/22

[52] U.S. Cl. ..... 149/11; 149/9; 149/10; 149/109.6; 149/100; 102/431; 264/3.1; 264/3.4

[58] Field of Search ..... 149/100, 9, 10, 11, 149/109.6; 264/3.1, 3.4; 102/430, 431, 432, 433

[56] References Cited

U.S. PATENT DOCUMENTS 4,068,589 1/1978 Oversohl ..... 149/14
4,284,592 8/1981 Evans et al. ..... 149/10
4,408,534 10/1983 Araki et al. ..... 149/2

*Primary Examiner*—Stephen J. Lechert, Jr.
*Attorney, Agent, or Firm*—Antonelli, Terry & Wands

[57] ABSTRACT

Unsupported, compressed propellant charge elements of nitrocellulose grains, as well as propellant charges produced from these propellant charge elements are produced by coating the grains with an acrylate resin and shaping the grains into cylindrical elements. The novel propellant charge elements are manufactured practically without concomitant use of binders or adhesives; they have a cylindrical configuration and contain a coaxial, continuous bore. These elements are suitable as building blocks for propellant charges in ammunition, e.g., for machinegun-type cannons. These building blocks can be used in a very simple form economically directly for the manufacturing of such ammunition. These novel charges contain at least three of the novel propellant charge elements; in this connection, the combustion of these charges can be adjusted at will by varying the propellant charge elements in order to obtain optimum combustion properties.

4 Claims, 7 Drawing Figures

UNSUPPORTED PROPELLANT CHARGE ELEMENT AND COMPACT CHARGE PRODUCED THEREFROM

The present invention relates to compressed propellant charge elements of nitrocellulose and charges produced therefrom.

Compressed propellant charge elements have been known, for example, from DOS No. 1,796,118. These propellant charge elements are utilized for appliances for industrial use and are present in the form of pellets. They are relatively small and break very easily. In order to overcome this drawback, this reference suggests to envelop these pellets with a protective resin film. Such pellets, however, cannot be used as propellant charges for projectiles.

It is furthermore known to encase nitrocellulose grains with resins, e.g., acrylic resins, and to manufacture, from these encased nitrocellulose grains, propellant charges which are combusted independently of the temperature. The resin coating over the grains is preferably 10–20% by weight of the nitrocellulose and provides a time-delayed combustion of the nitrocellulose. Such grains are, therefore, utilized preferably in a mixture with nitrocellulose grains not coated with resins in the so-called duplex charges (see U.S. Pat. No. 4,106,960). In general, these nitrocellulose grains are emloyed in cartridges or cases into which they are poured and pressed into place, if desired, under an only low compacting pressure. Such nitrocellulose grains have not been utilized heretofore for the production of self-supporting compressed elements.

Therefore, the object resides in producing propellant charge elements built up predominantly of single-or multiple-base propellant powders which are self-supporting, exhibit adequate mechanical strength without a resin casing, and do not contain any additional binder or adhesive which could adversely affect the combustion properties.

In attaining this object, unsupported, compressed propellant charge elements of nitrocellulose powder grains, as well as propellant charges manufactured therefrom, have now been discovered which are characterized in that (a) the nitrocellulose powder grains are coated with an acrylate resin layer constituting 0.5–6% by weight of the grains, (b) compressing takes place with a pressure force of between 500 and 1,500 kg/cm$^2$ [49,000 N/m$^2$ to 150,000 N/m$^2$] and without concomitant use of an additional adhesive, and (c) the thus-obtained element is fashioned as a cylinder having a continuous axial bore, the height of which is between 70 and 200% of the diameter of the cylinder and the axial bore of which has a diameter of 15–30% of the diameter of the cylinder.

The propellant chrages of this invention contain as the predominant component, single- or multiple-base propellant powders in the form of powder grains. These powder grains are preferably present in the form of multi-hole powder grains.

Nitrocellulose is the main component in the single- as well as multiple-base powders. The multiple-base powders contain either a nitrocellulose/nitroglycol and/or a nitrocellulose/nitroglycerin mixture, or they include nitroguanidine and diethylene glycol dinitrate as additional combustible, gas-yielding components. Furthermore, the powders can additionally contain small amounts of conventional stabilizers, combustion moderators or lubricants, respectively, in quantities of up to maximally 2% by weight.

Application of the acrylate resin coatings to the powder grains takes place in a manner known per se by spraydrying. The acrylic resins correspond to such resins which are cited in U.S. Pat. No. 4,106,960. These resins are generally used in lacquers, which find application as protection coating for vehicles of every day use. The resin in this procedure is preferably sprayed from an aqueous solution, and the grains are subsequently dried under agitation. This process is, if necessary, repeated until the thus-applied amount of resin is so large that is constitutes between 0.5 and 6% by weight of the weight of the powder grains.

Thereafter, the thus-encased powder grains are compressed into the molded elements having a cylindrical shape as heretofore described. Within a mould of the desired shape press molding takes place conventionally under a compacting pressure of between 500 and 1,500 kg/cm$^2$ (49,000–150,000 Pa) without adding a binder or adhesive, at a compression temperature of 20°–60° C. The thus-attained degree of consolidation can be up to 1.5 times the normal bulk density of the powder.

The molded elements have a cylindrical shape. The height of the elements generally corresponds to their diameter, but can also be larger than the diameter by up to 100%, preferably up to 50%. It is also possible for the height of the elements to be smaller than the diameter, but the height should not fall below 70% of the diameter.

The molded elements are furthermore characterized in that the elements each contain an axial central bore, the diameter of which is generally constant over its length. Preferably, the diameter corresponds to that of an igniter element and an ignition booster, with the aid of which the elements in a charge according to the present invention are ignited. In general, the diameter of the bore is about 15–30% of the diameter of the cylindrical molded elements.

The bore within a compressed element can also exhibit differing diameters; that is necessary, in particular, with those elements within which a projectile is mounted in case of the compact charge according to this invention. The bore, then, corresponds to the shape of the part of the projectile to be encased; in these instances, the compressing step is suitably conducted with the projectile having been inserted in the press mold.

Although the propellant charge moldings of this invention are compressed without adding binders or adhesives, they exhibit adequate mechanical strength for being further processed into the compact charges. On the other hand, the molded elements disintegrate very readily under the effect of gas and pressure, so that regular combustion after ignition is ensured. The combustion characteristic can be influenced by the degree of consolidation.

The molded propellant charge elements serve as building blocks for compact charges utilized as propellant charges for projectiles. It is consequently possible with the air of these building blocks to manufacture directly, in an economical fashion, ammunition, for example, for machine gun-type cannons, with a high degree of automation.

The compact charges according to this invention contain at least three of the molded propellant charge elements arranged in series in such a way that their central bores form a continuous duct, an ignition unit, optionally with an ignition booster being disposed at the beginning thereof, and this duct terminating with the tail of the projectile.

The molded propellant charge elements are arranged within a case of a combustible paper, the inner diameter of this case corresponding to the outer diameter of the propellant charge cylinders. Such combustible cases are known per se. Their manufacture has been described, for example, in British Pat. No. 909,391.

The molded propellant charge elements containing the projectile and the ignition unit(s) are to exhibit differing densities. Also, their density is to be higher than the density of the molded elements arranged between them. The molded element carrying the projectile is to exhibit the highest density.

It is furthermore possible to arrange charges bringing about uniform ignition within the bore of the molded elements arranged in the center. Compositions for such charges are known per se. These charges can also be prefabricated as modules by arranging them within a combustible case containing nitrocellulose. In this arrangement, the charges can also be present in the form of annular pills. These charges occupy maximally 80% of the free volume of the bores.

The invention will be explained by way of an example with reference to the accompanying drawings wherein.

Figure 1:
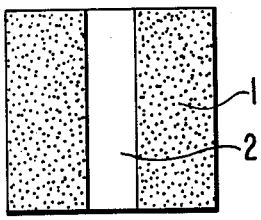
FIG. 1 represents a longitudinal section through a molded element.

In all of the figures, reference numeral 1 denotes the pressed propellant charge element and reference numeral 2 denotes the central bore within the compressed element. A triple-base powder with a proportion of 75% of nitrocellulose was utilized for producing the elements. Besides, the powder also contained 1.0% by weight of diphenylurea, 0.9% by weight of potassium sulfate, and 0.1% by weight of graphite. The powder was compacted under a compression force of 50,000 Pa. Consolidation was 1.4 times the bulk density.

Figure 2:
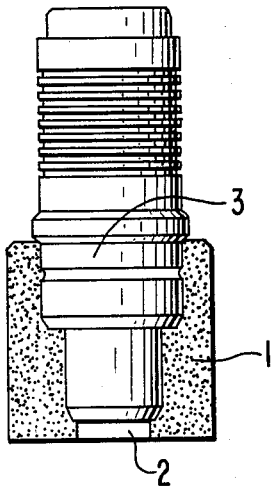
FIG. 2 is a longitudinal section through yet another molded element, in the central bore of which a short-range projectile with a tip (not shown) is arranged.

FIG. 2 shows a pressed-in projectile 3 in a comprssed propellant charge element according to this invention. In this embodiment, the bore 2 can also be filled partially or entirely with compressed propellant charge powder in order to impart a firmer seating to the projectile.

Figure 3:
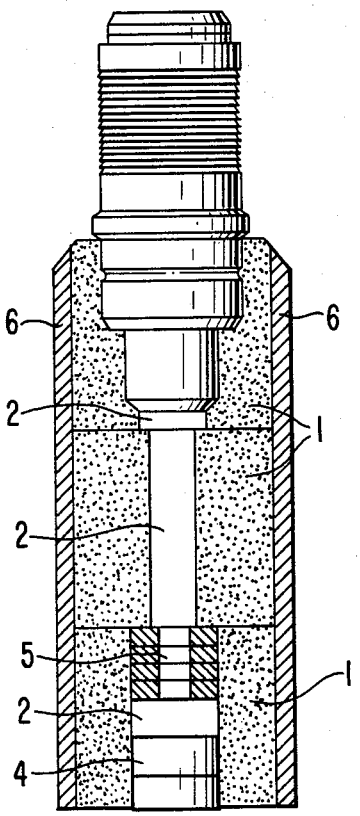
FIGS. 3 and 4 are longitudinal sections through a compact charge made up of a plurality of the molded elements.

In FIG. 3, three propellant charge elements according to the invention are joined into a compact charge surrounded by a nitrocellulose-containing case 6; in an outer propellant charge element of this compact charge, an percussion sensible, fully combustible igniter 4 known in the art and an ignition booster 5—preferably $KNO_3$/Boron—are disposed within the bore 2. Instead of one central propellant charge element, it is also possible to arrange several of these elements in series. The propellant charge in the central propellant charge element has a degree of compacting of 1.3. The compacting of the propellant charge wherein the projectile is arranged is 1.45 times the bulk density, and that of the propellant charge carrying the igniter elements is 1.4 times the bulk density.

Figure 4:
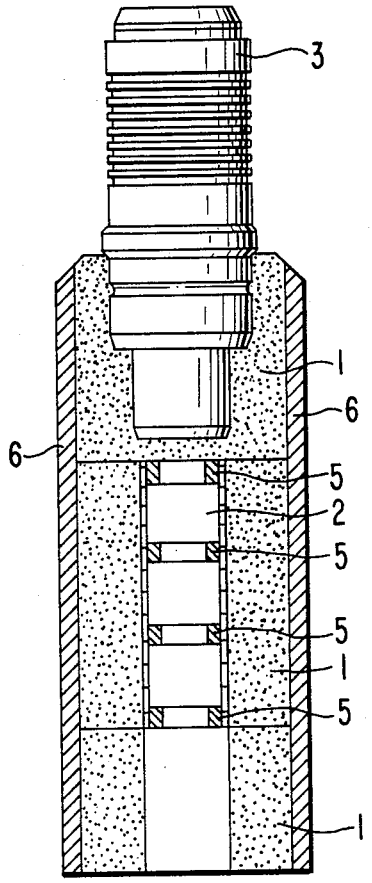

FIG. 4 shows another possible embodiment wherein the ignition booster 5 in the form of several annular pills is arranged within a nitrocellulsoe-containing case 7. This case is located within the central bore 2 of the central propellant charge element in intimate contact with the wall of the latter.

Figure 5:
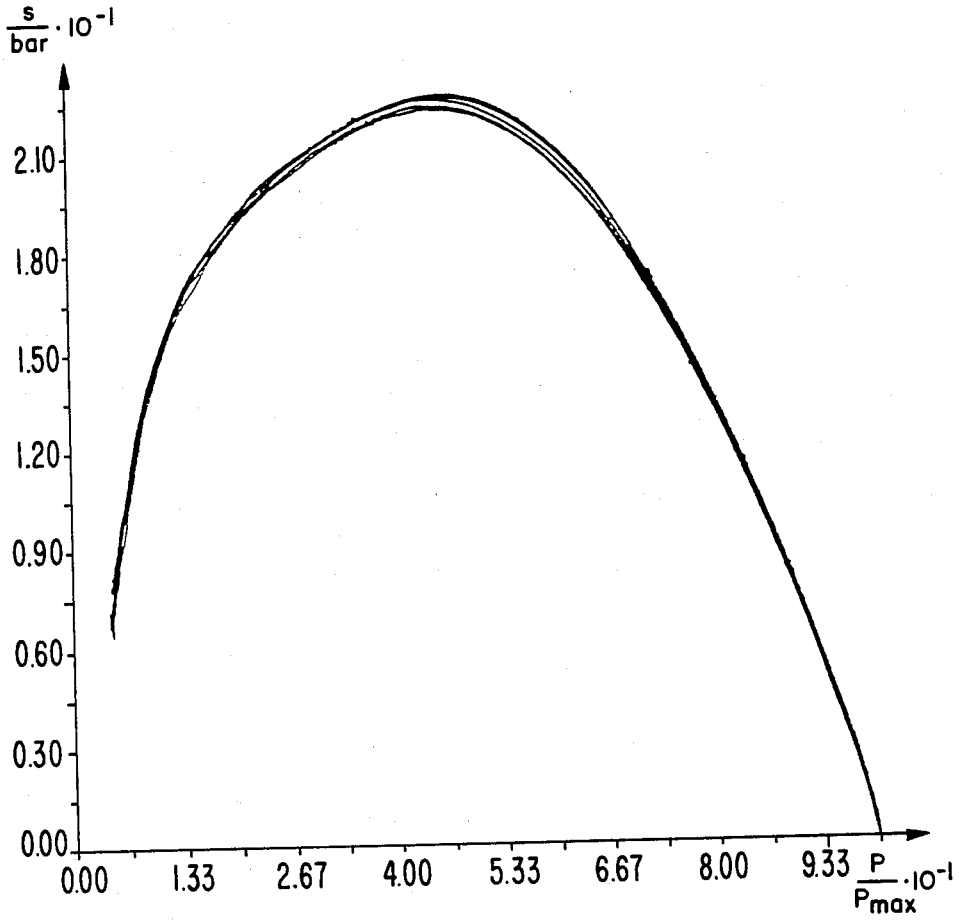
FIGS. 5–7 show curves regarding the combustion characteristics of green-grain powder (FIG. 5), powder coated with acrylic resin (FIG. 6) and propellant charge elements corresponding to the present invention.
Figure 6:
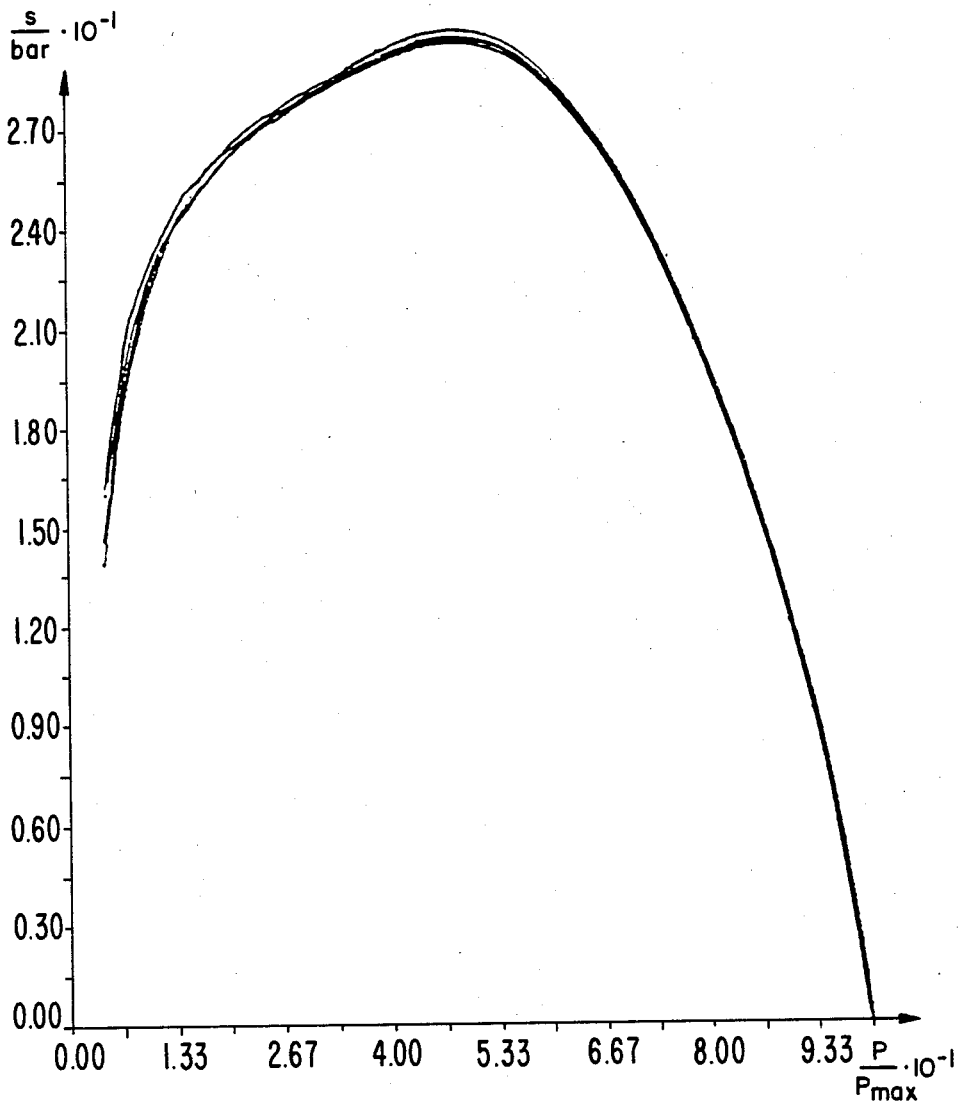
Figure 7:
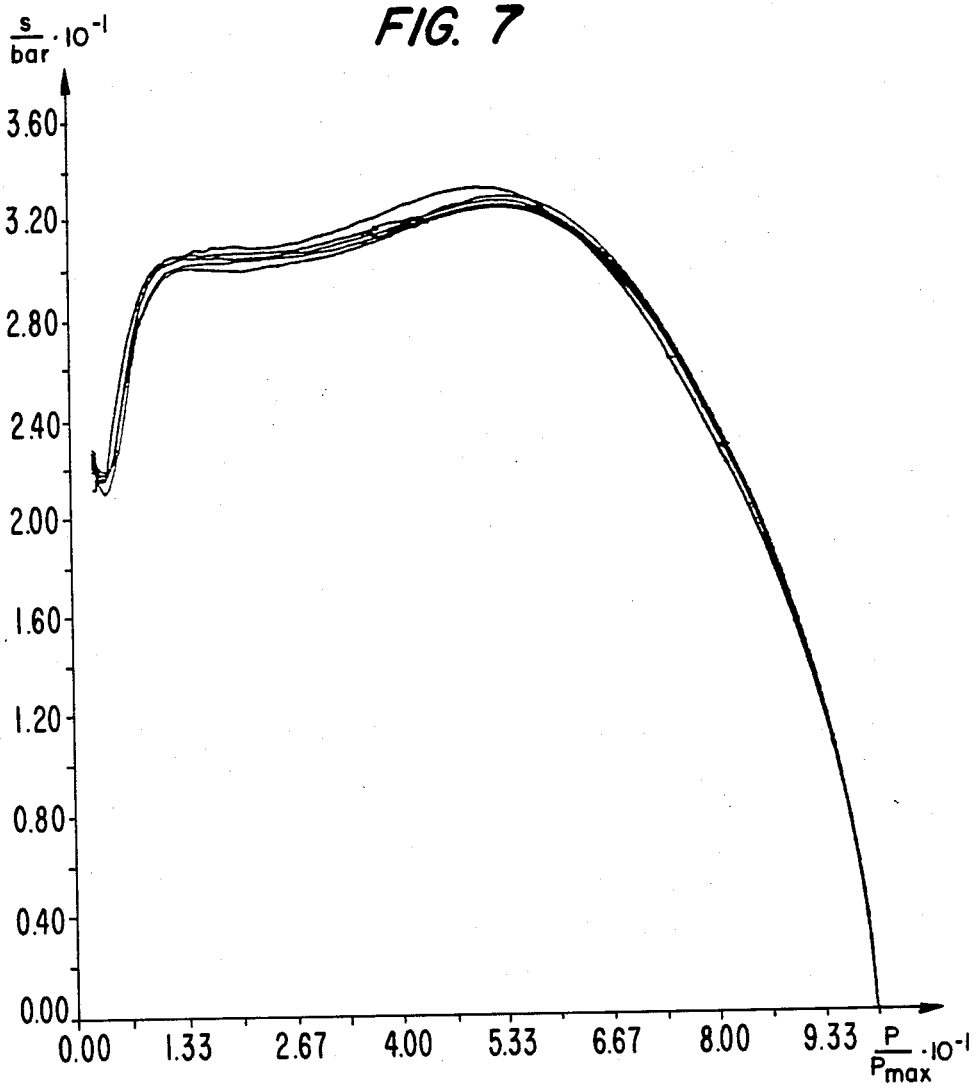

FIGS. 5–7 represent the results of combustion tests in a ballistic bomb. The curves show dyanmic activity in $s/bar \cdot 10^{-1}$ at a charge density of 300 $kg/m^3$ and a test temperature of 20° C. The curves indicate in each case the results from five firings.

FIG. 5 serves as comparison; in this curve, the combustion of untreated propellant charge powder (green-grain powder) is depicted.

FIG. 6 shows the combustion of an indentical powder after treatment with 1.5% by weight of acrylate resin.

FIG. 7 indicates the combustion characteristic of a propellant charge element according to this invention made up of propellant charge grains corresponding to FIG. 6.

FIG. 6 demonstrates the effect of the acrylate treatment: the rise of the curve is shallower, and the pressure maximum is reduced to values lower than in FIG. 5 without a delay in the progressiveness of the combustion. In the propellant charge elements of this invention according to FIG. 7, initial combustion is still further delayed in the desired way, and the pressure maximum still further reduced without decreasing the progressiveness of the combustion.

These results make it apparent that the steps taken by this invention yield propellant charge elements which provide improved internal-ballistics values during their combustion. In live firings, these results have been confirmed: with propellant charge elements according to this invention, with a maximum pressure of 3,250 bar, an initial velocity $V_o$ was attained of 1,100 m/s; whereas, with case ammunition with a poured-in propellant charge corresponding to the state of the art, a maximum pressure of 3,600 bar was needed for an initial velocity $V_o$ of 1,100 m/s.

What is claimed is:

1. Unsupported, compressed propellant charge elements of nitrocellulose powder grains, coated with a resin layer, characterized in that:
   (a) the nitrocellulose powder grains are coated with an acrylate resin layer constituting 0.5–6% by weight of the grains,
   (b) compressing takes place with a pressure force of between 500 and 1,500 $kg/cm^2$ [49,000 $N/m^2$ to 150,000 $N/m^2$] and without concomitant use of an additional adhesive, and
   (c) the thus-obtained element is fashioned as a cylinder having a continuous axial bore, the height of which is between 70 and 200% of the diameter of the cylinder and the axial bore of which has a diameter of 15–30% of the diameter of the cylinder.

2. A compact charge produced with the use of propellant charge elements according to claim 1, characterized in that at least three propellant charge elements are arranged in series within a combustible, nitrocellulose-containing paper case in intimate contact with the latter, wherein:
   (a) one of the outer elements encompasses a projectile and has a high density,
   (b) the other outer element exhibits an axially disposed igniter and optionally an ignition booster and has a density lower than the density of the element containing the projectile, and (c) one or several propellant charge elements are disposed between the elements (a) and (b), the density of these first-mentioned charge elements being lower than the densities of the elements (a) and (b).

3. A compact charge according to claim 2, characterized in that each central element contains within a central bore a charge enhancing ignition, which charge occupies up to 80% of the volume of the bore.

4. A compact charge according to claim 3, characterized in that the charge enhancing ignition is contained within a combustible case of nitrocellulose-containing paper, optionally in the shape of annular pills.

* * * * *